US005954537A

United States Patent [19]

Sonobe et al.

[11] Patent Number: 5,954,537

[45] Date of Patent: Sep. 21, 1999

[54] FLEXIBLE FLAT CABLE AND CONNECTOR FOR CONNECTING THE SAME

[75] Inventors: Toshimitu Sonobe, Tokyo; Masakazu Koiso, Miyage-ken; Akiyoshi Oshitani, Tokyo, all of Japan

[73] Assignee: Thomas & Betts International, Inc., Sparks, Nev.

[21] Appl. No.: 09/035,914

[22] Filed: Mar. 6, 1998

Related U.S. Application Data

[63] Continuation of application No. 08/697,757, Aug. 29, 1996, abandoned.

[30] Foreign Application Priority Data

Aug. 18, 1995 [JP] Japan ..... 7-210642
Oct. 23, 1995 [JP] Japan ..... 7-274231

[51] Int. Cl.[6] ..... H01R 9/07

[52] U.S. Cl. ..... 439/495; 439/67

[58] Field of Search ..... 439/67, 495, 492, 439/493, 77, 496

[56] References Cited

U.S. PATENT DOCUMENTS

| | | | |
|---|---|---|---|
| 3,082,398 | 3/1963 | Valach | 439/67 |
| 3,084,302 | 4/1963 | Braeutigam | 439/67 |
| 3,114,587 | 12/1963 | Hermann | 439/67 |
| 3,278,887 | 10/1966 | Travis | 439/67 |
| 3,319,216 | 5/1967 | McCullough | 439/67 |
| 3,393,392 | 7/1968 | Shelley | 439/67 |
| 3,486,159 | 12/1969 | Matthews | 439/67 |
| 3,696,319 | 10/1972 | Olsson | 439/495 |
| 3,772,775 | 11/1973 | Bonnke et al. | 439/67 |
| 3,897,130 | 7/1975 | Donnelly et al. | 439/67 |
| 3,923,364 | 12/1975 | Shapiro et al. | 439/67 |
| 4,235,500 | 11/1980 | Belopavlovich et al. | 439/67 |
| 4,265,507 | 5/1981 | Johnson | 439/67 |
| 4,379,608 | 4/1983 | Olsson et al. | 439/67 |
| 4,422,700 | 12/1983 | Krenz | 439/67 |
| 4,573,752 | 3/1986 | Rich | 439/495 |
| 4,639,063 | 1/1987 | Mueller | 439/67 |
| 4,681,382 | 7/1987 | Lockard | 439/497 |
| 4,684,183 | 8/1987 | Kinoshita et al. | 439/77 |
| 4,750,881 | 6/1988 | Kikuchi et al. | 439/495 |
| 4,824,391 | 4/1989 | Ii | 439/67 |
| 4,902,236 | 2/1990 | Hasircoglu | 439/77 |
| 4,938,702 | 7/1990 | English | 439/67 |
| 4,944,690 | 7/1990 | Imai | 439/495 |
| 4,971,575 | 11/1990 | Martellotti | 439/496 |
| 5,030,794 | 7/1991 | Schell et al. | 174/36 |
| 5,044,980 | 9/1991 | Krumme et al. | 439/496 |
| 5,097,099 | 3/1992 | Miller | 174/36 |
| 5,209,671 | 5/1993 | Sugimoto et al. | 439/67 |
| 5,262,590 | 11/1993 | Lia | 174/36 |
| 5,297,968 | 3/1994 | Johnson et al. | 439/67 |
| 5,383,788 | 1/1995 | Spencer | 439/67 |

(List continued on next page.)

FOREIGN PATENT DOCUMENTS

| | | |
|---|---|---|
| 0 759 650 A3 | 6/1998 | European Pat. Off. . |
| 49-8168 | 1/1974 | Japan . |
| 60-109280 | 7/1985 | Japan . |
| 3-29280 | 2/1991 | Japan . |
| 6-68940 | 3/1994 | Japan . |
| 8-203626 | 2/1996 | Japan . |

*Primary Examiner*—Paula Bradley
*Assistant Examiner*—Tho D. Ta
*Attorney, Agent, or Firm*—Hoffmann & Baron, LLP

[57] ABSTRACT

The flexible flat cable has an insulating base film, at least two sets of conductor groups and an insulating cover layer for covering the conductor groups. An end of the cable has, on one surface thereof, conductor contact areas formed by directly and partially exposing conductors of the conductor groups or partially exposing conductor area electrically connected to the conductors. The conductor contact areas are aligned along the width of the cable for each conductor group. The connector for connecting the cable has a connector body and a retainer plate and pinches the cable between the connector body and the retainer plate and contacts the conductor contact areas of the cable to the corresponding contacts on the opposite sides of the connector body to make electrical connection therebetween.

4 Claims, 9 Drawing Sheets

U.S. PATENT DOCUMENTS 5,397,247 3/1995 Aoka et al. ..... 439/496
5,403,202 4/1995 Roehling ..... 439/493
5,414,220 5/1995 Hanato et al. ..... 439/67
5,428,187 6/1995 Crane et al. ..... 174/36
5,433,632 7/1995 Cherney et al. ..... 439/495
5,507,651 4/1996 Tanaka et al. ..... 439/67
5,529,502 6/1996 Peltier et al. ..... 439/67
5,616,050 4/1997 Suski ..... 439/495

FLEXIBLE FLAT CABLE AND CONNECTOR FOR CONNECTING THE SAME

This application is a continuation of copending application Ser. No. 08/697,757, filed on Aug. 29, 1996 now abandoned.

FIELD OF THE INVENTION

The present invention relates to a flexible flat cable (for example, flexible printed circuit board (FPC)) and a connector for connecting the same.

BACKGROUND OF THE INVENTION

Cable and connector of this type adopt a construction of inserting an exposed portion of leads (or electrodes) at an end of the cable into a housing groove formed in the connector to make contact with contacts accommodated therein.

In this case, as the number of leads of the cable increases, the arrangement of the contacts of the receiving connector becomes narrower and a higher manufacturing accuracy is required and it becomes harder to attain a necessary strength. Further, a contact area between the lead of the cable and the contact reduces and failure of the contact is apt to occur.

SUMMARY OF THE INVENTION

The present invention relates to solve the prior art problems by connecting the leads of the cable with the contacts by using the retainer cable rather than connecting the leads of the cable with the contact the accommodating groove of the connector as they are in the prior art.

In order to achieve the above object, the present invention provides a flexible flat cable comprising an insulating base film, at least two sets of conductor groups each having a plurality of parallel arranged conductors provided in one or both surfaces of said case film, and an insulating cover layer for covering said conductor groups. An end of said cable has on one surface thereof conductor contact areas formed by directly and partially exposing the conductors of said conductor groups or partially exposing conductor contact areas electrically connected to said conductors, and the conductor contact areas are aligned along the width of the cable for each conductor group.

The present invention further provides a flexible flat cable as described above further comprising at least one shielding area integrally extending along the width of said cable, said shield area being foldable to lie on said cable and has a conductor plane connected with one of the conductors of the conductor groups of said cable.

The present invention further provides a connector for connecting the flexible flat cable as described above comprising a connector body and a retainer plate. The connector body is provided with a plurality of contacts on each of the opposite sides along a longitudinal side of said connector body, pinches said flexible flat cable between said connector body and said retainer plate, contacting said conductor contact areas of said cable to the corresponding contacts to make electrical connection therebetween and contacting, as required, grounding contact areas different from said conductor contact areas and formed on an opposed side of said cable to said retainer plate to make electrical connection therebetween.

BRIEF DESCRIPTION OF THE DRAWING FIGURES

DETAILED DESCRIPTION OF THE PREFERRED EMBODIMENT(S)

Figure 1:
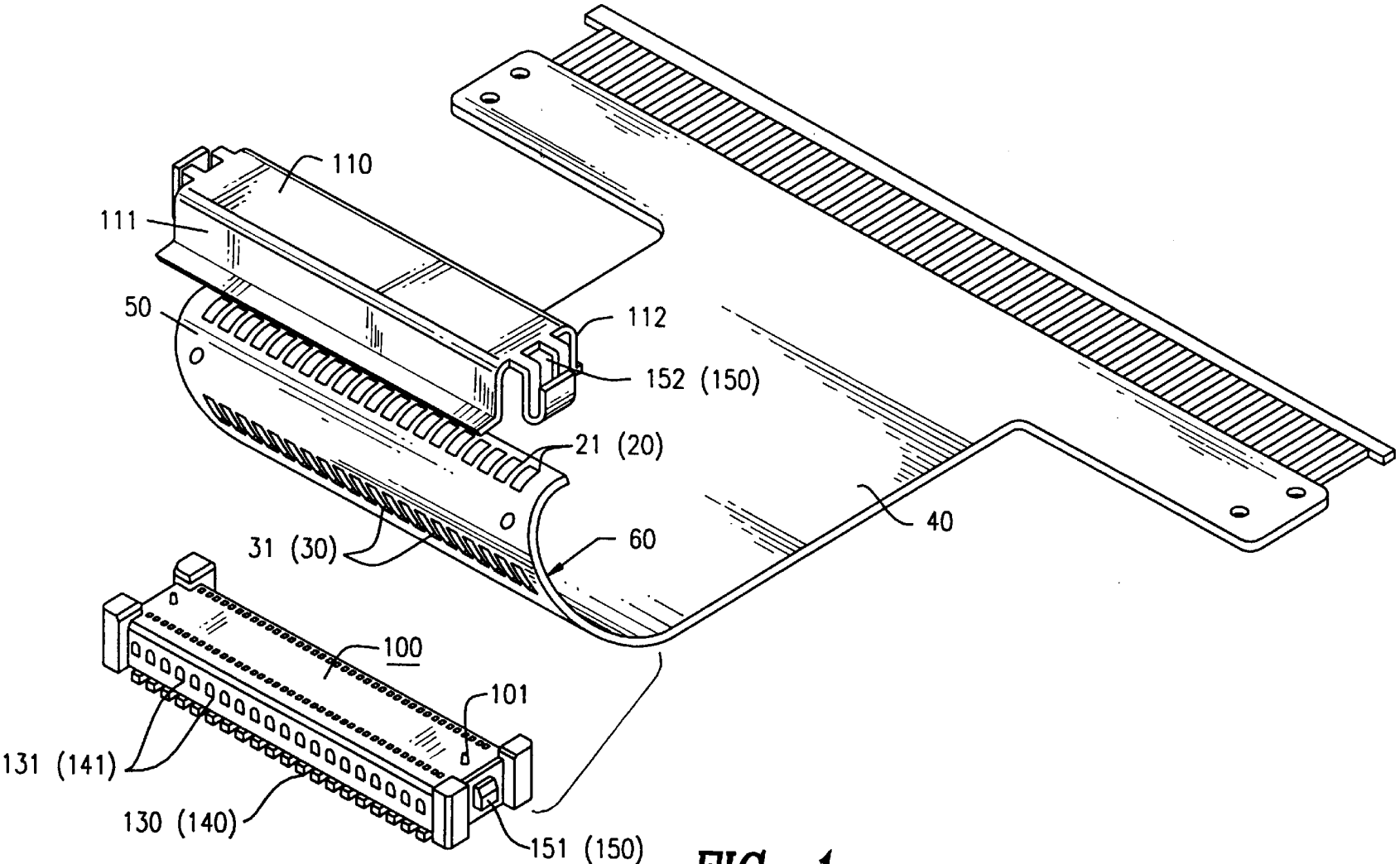
FIG. 1 shows a perspective view showing a status before connection in one embodiment of a cable and a connector of the present invention.
Figure 2:
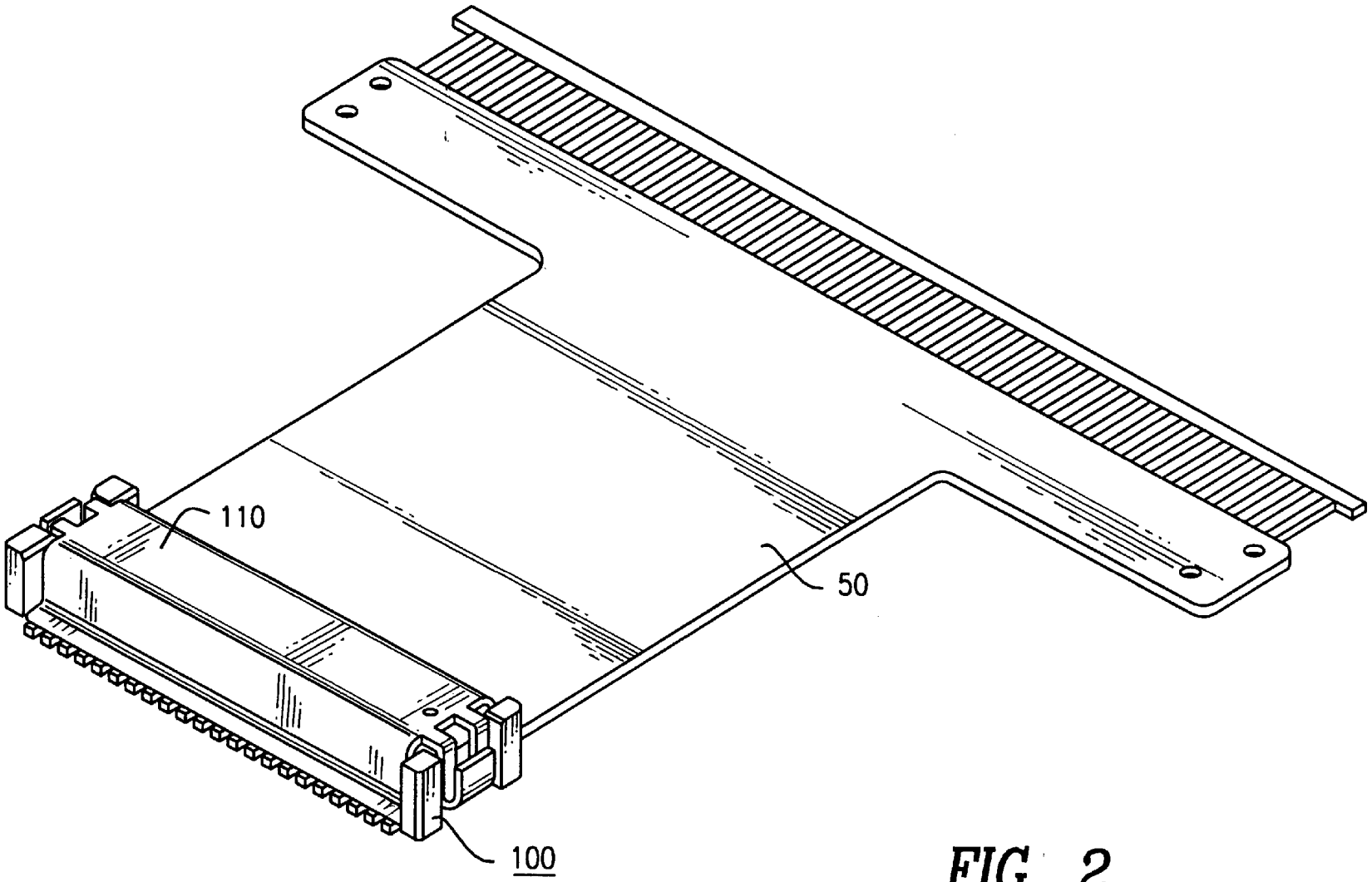
FIG. 2 shows a perspective view showing a status of completion of connection of the connector and the cable of FIG. 1.
Figure 3:
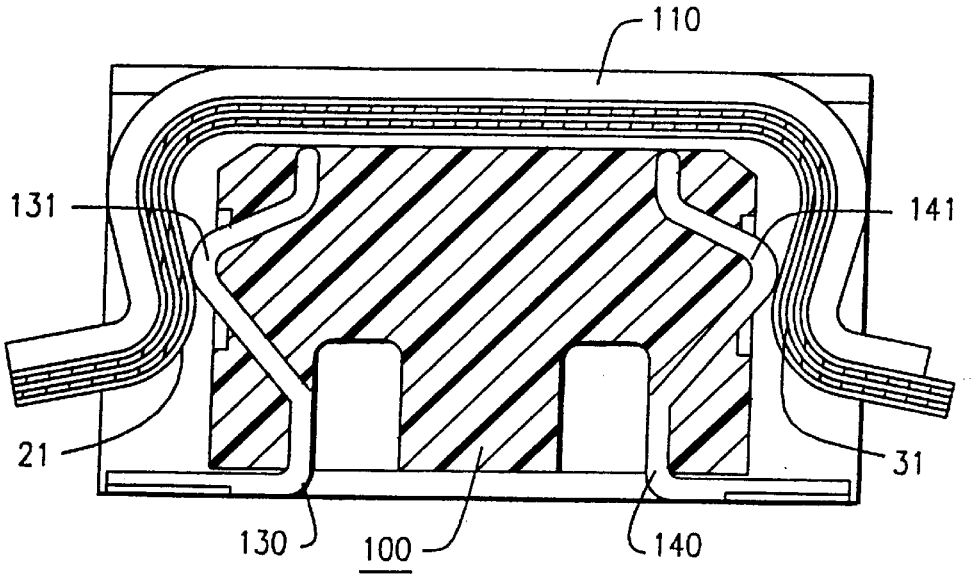
FIG. 3 shows a sectional view of the cable and the connector in the completion status of connection.

FIGS. 1–3 show one embodiment of a flexible flat cable and a connector for connecting the same in accordance with the present invention. FIG. 1 shows a status before the connection of the cable and the connector. FIG. 2 shows a status of completion of connection and FIG. 3 shows a sectional view of the connector in that status. The cable in FIG. 1 is shown with an end thereof curved to allow the observation of a pattern plane of the cable.

The cable in the illustrated embodiment comprises an FPC having conductor groups 20 and 30 each comprising a plurality of parallel conductors arranged on a surface of an insulating base film 10 and having insulating cover layers 40 and 50 formed on the conductor groups to cover them. Conductor contact areas 21 and 31 formed by directly and partially exposing the conductors of the conductor groups or partially exposing the conductor areas electrically connected to the conductors are provided at one end 60 of the cable to align in along the width of the cable.

In the embodiment shown in FIGS. 1–3, two sets of conductor groups are provided although the conductor group may be provided on only one surface thereof.

In the illustrated embodiment, a number of electrodes are provided at the other end of the cable to allow the connection with an electronic element (for example, a display).

Detail of the cable will be discussed below in conjunction with other embodiments.

In FIGS. 1–3, the connector for connecting the flexible flat cable comprises a connector body 100 and a retainer plate 110. The connector body is provided with a plurality of contacts 130 and 140 on both sides along the longitudinal direction. The flexible flat cable is pinched between the connector body and the retainer plate. The contacts provided on both sides of the connector body contact to the exposed conductor contacts 21 and 31 of the cable to make electrical connection.

Each contact of the connector has a contact 131 or 141 extending from the connector body to pinch the exposed conductor contact 21 or 31 of the cable between the retainer plate and the contact area to secure the electrical connection of the contact area and the conductor contact area of the cable. In the illustrated embodiment, the contact areas are located at opposing and parallel corners (upper edge of a side) of the connector body.

The retainer plate has a generally U-shaped lateral section and pinches the cable with the connector.

Specifically, it has a pair of opposing plate pieces 111 and 112 (which act as leaf springs) to hold the exposed conductor contact areas of the cable in contact with the contact areas.

The connector body and the retainer plate have engagement means 150 for engaging with each other with the cable being pinched therebetween. Specifically, the engagement means comprises a projection 151 provided at each of both shorter sides of the connector body and an engagement hole 152 formed at a position of the retainer plate corresponding to the projection.

A guide post 101 is provided on a top plane of the connector body and when the connector and the cable are connected, guide holes formed in the retainer plate and the cable respectively are extended through by the guide post.

Figure 4:
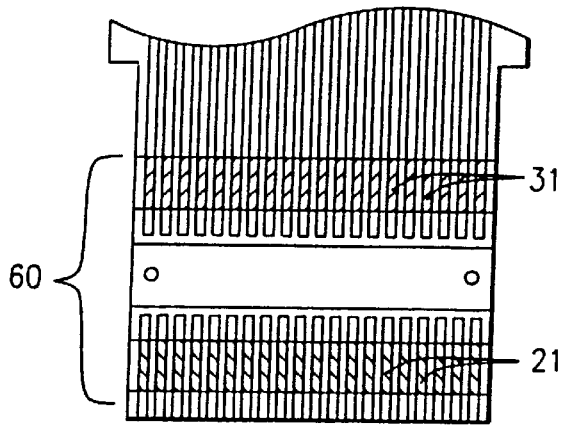
FIG. 4 shows a plan view of detail of the cable of FIG. 1.
Figure 5:
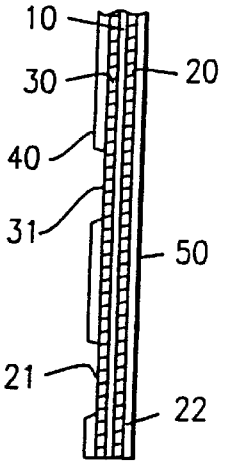
FIG. 5 shows a longitudinal sectional view of the cable of FIG. 4.

FIGS. 4 and 5 show details of the cable of FIGS. 1–3. As shown, the two sets of conductor groups 20 and 30 are provided on the both surfaces of the base film 10 and the respective conductor groups are covered by the cover layers 40 and 50. On one surface at the end 60 of the cable, the conductors of one of the conductor groups provided on that surface are directly and partially exposed to form the conductor contact areas 31. For the other conductor group, the conductor areas electrically connected to the conductor group through via holes 22 are exposed to form the conductor contact areas 21.

As seen from FIG. 5, a gap is formed in the cable to prevent the conductor areas connected to one conductor group through the via holes (exposed areas of which forms the conductor contact areas 21) from being contacted to the other conductor group (a portion of which is exposed to form the conductor contact areas 31).

Figure 6:
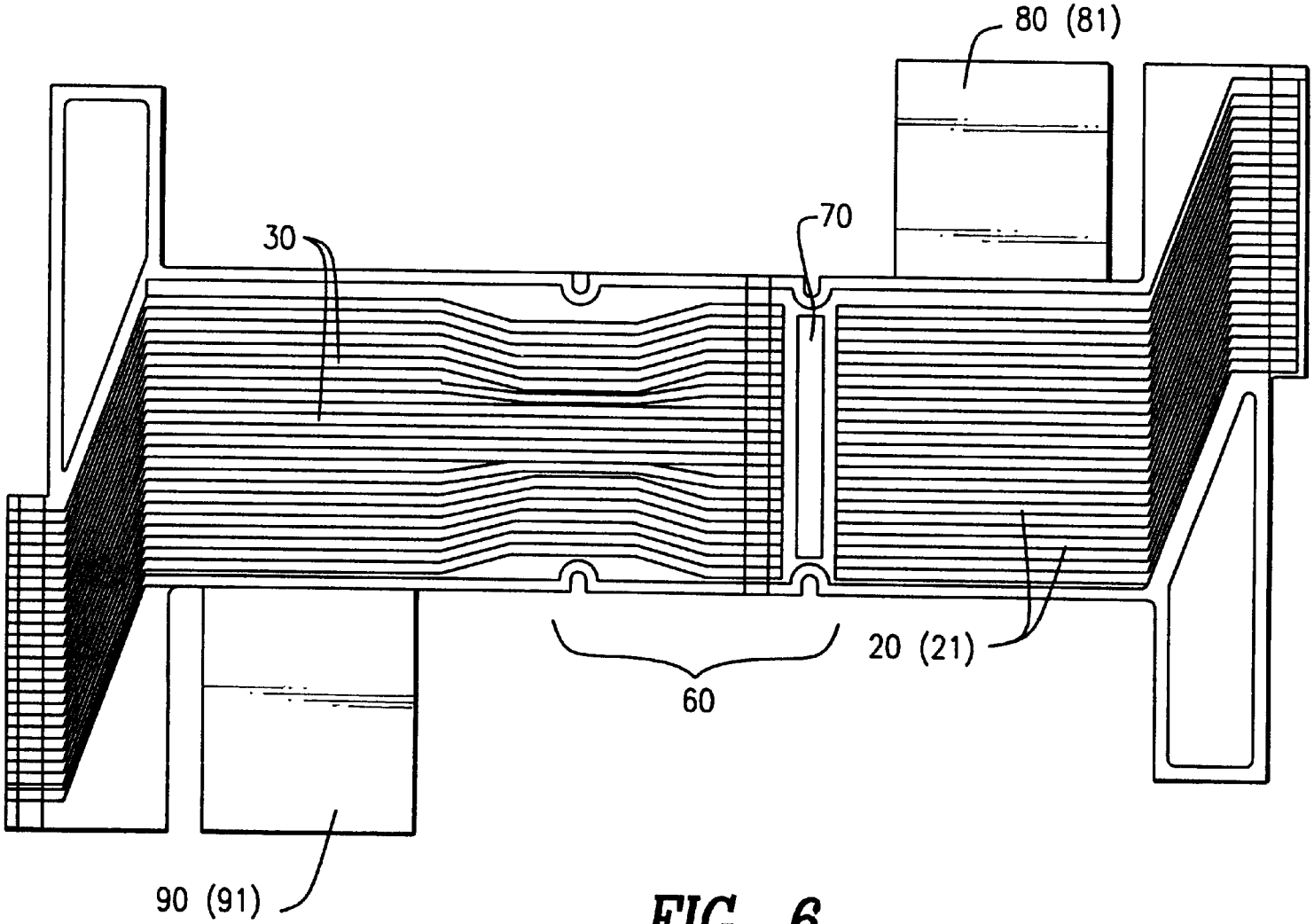
FIG. 6 shows a developed view of another embodiment of the cable of the present invention.

FIG. 6 shows another embodiment of the cable of the present invention (shown in a developed form). In the present cable, two sets of conductor groups 20 and 30 are arranged to oppose to each other with a predetermined spacing 70 therebetween on one surface of the insulating base film. The conductor groups are covered by the insulating cover layer 40. Each of the conductor groups comprises a plurality of parallel conductors.

An end 60' of the cable is bent at a position close to a spacing between the two sets of conductor groups. The end has areas 21 and 31 on the opposite side of the spacing in which the conductors of the conductor groups are partially exposed and the exposed areas are aligned along the width of the cable.

Figure 7:
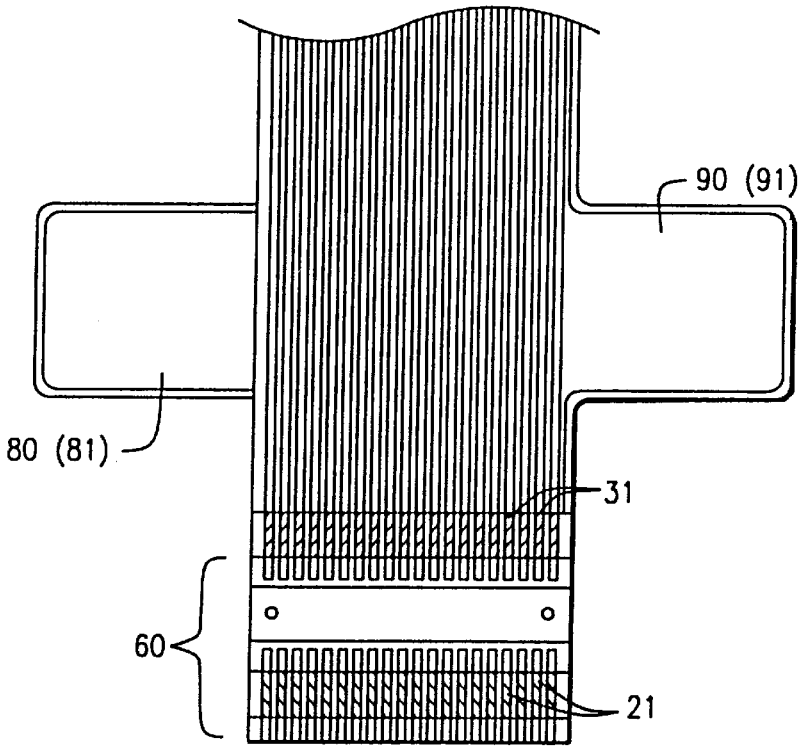
FIG. 7 shows a plan view showing a status before folding back a shield area in still another embodiment of the cable of the present invention.
Figure 8:
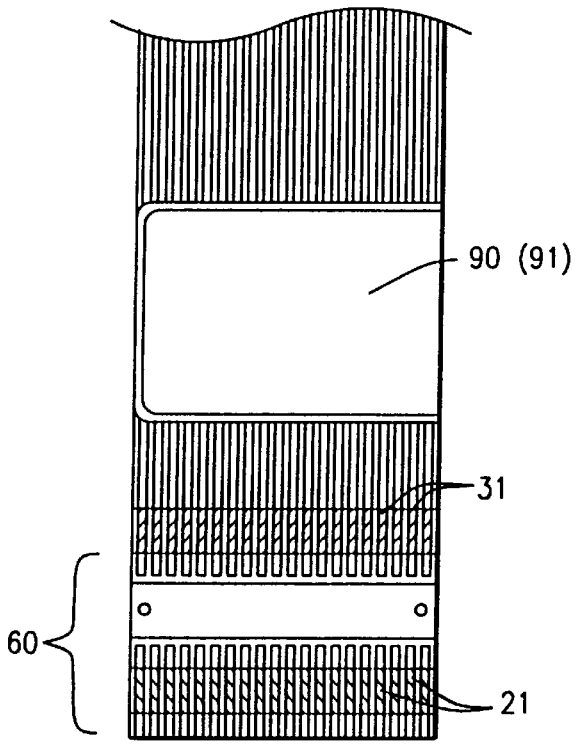
FIG. 8 shows a plan view showing a folded back status of the shield area in the cable of FIG. 7.
Figure 9:
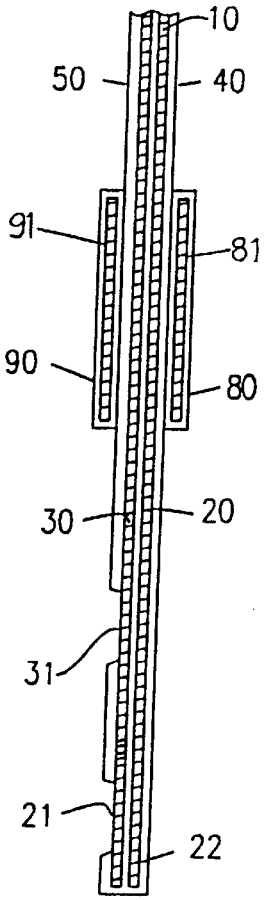
FIG. 9 shows a longitudinal sectional view of the cable of FIG. 8.

FIGS. 7–9 show other embodiment of the cable of the present invention. The present embodiment relates to a cable having shield means.

The construction of the cable is basically identical to the cable of FIGS. 4 and 5 except that at least one of the shield area 80 and 90 which integrally extend along the width of the cable is provided. (In the illustrated embodiment, the shield areas are provided on the front and rear surfaces of the cable). The shield areas are foldable so that they may be laid on the cable and the shield areas are provided with conductor planes 81 and 91 connected with one of the conductors of the conductor groups of the cable. (In the illustrated embodiment, they are connected to portions of the conductor groups provided on the front and rear surfaces of the cable).

FIG. 7 shows a status before the fold-back of shield areas and FIG. 8 shows a status after the fold-back of the shield areas onto the cable body. FIG. 9 shows a sectional view thereof. In the illustrated embodiment, a pair of shield areas are provided and they may be folded on both the front and rear surfaces of the cable although only one shield area may be used with the shield area being capable of folding back to one of the surfaces of the cable.

Figure 10:
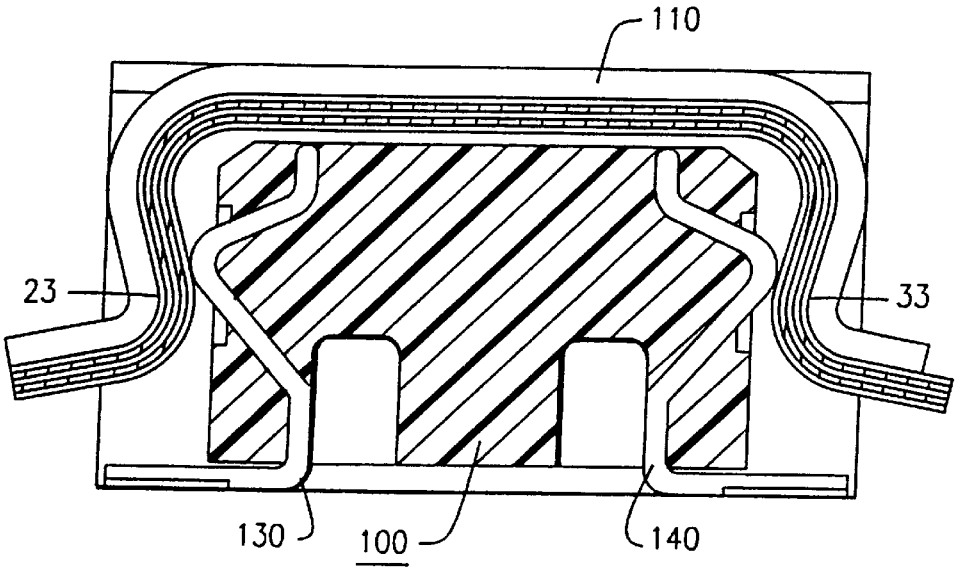
FIG. 10 shows a sectional view showing a connection status of still another embodiment of the cable of the present invention with a connector.

FIG. 10 shows an embodiment in which the retainer plate (made of a conductive material) and the shield area of the cable are electrically connected and grounded.

Conductor contact areas (21, 31) are provided on one surface of the flexible flat cable as they are in the above embodiments, and grounding conductor areas (23, 33) are provided on the opposite surface by directly and partially exposing the conductor planes of the shield areas or partially exposing the conductor areas electrically connected to the conductor planes.

When the cable is pinched between the retainer plate and the connector body by the retainer plate, the retainer plate and the grounding conductor contact areas contact to make electrical connection.

Figure 11:
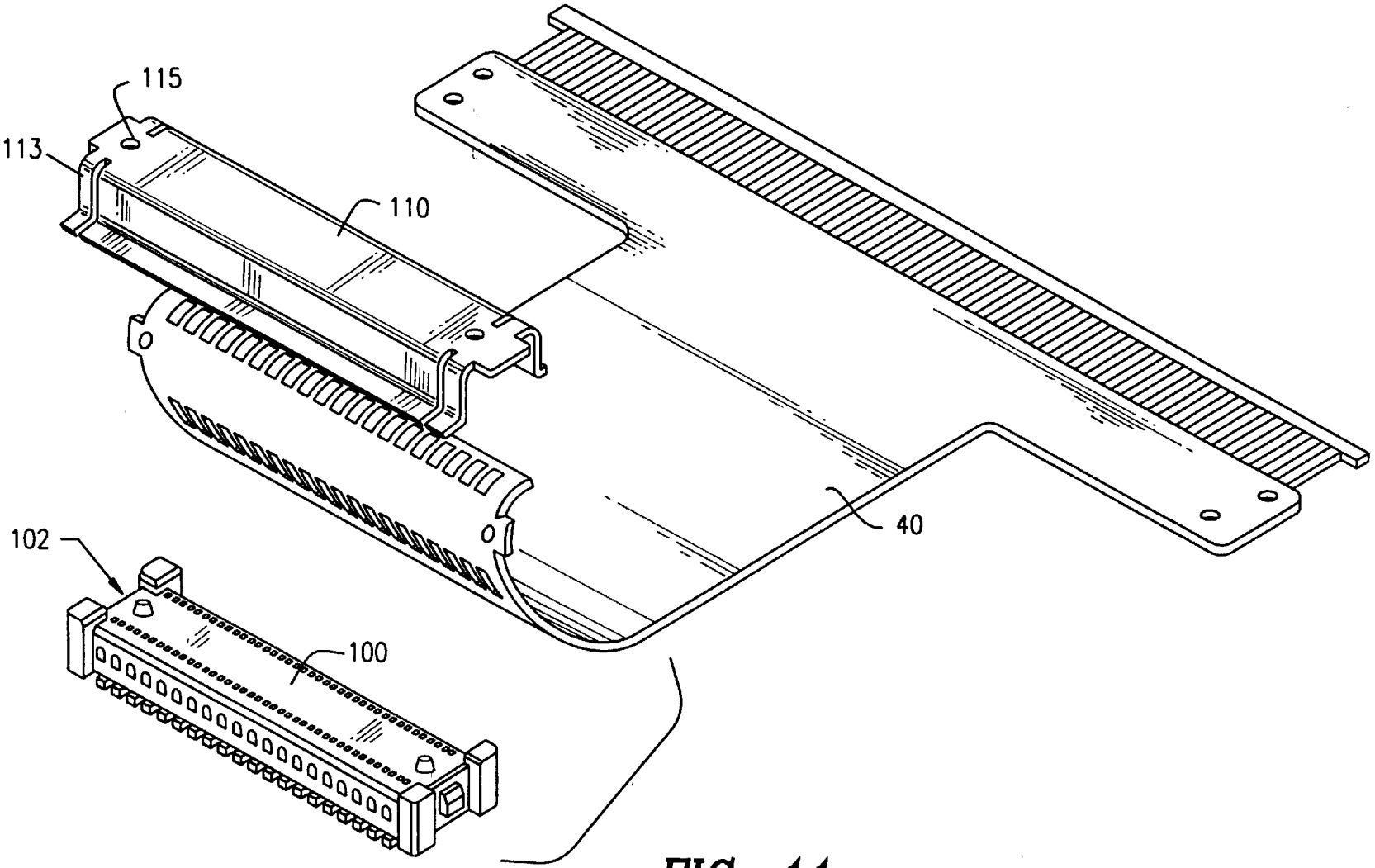
FIG. 11 shows a perspective view showing a status before connection of still another embodiment of the cable and the connector of the present invention.
Figure 12:
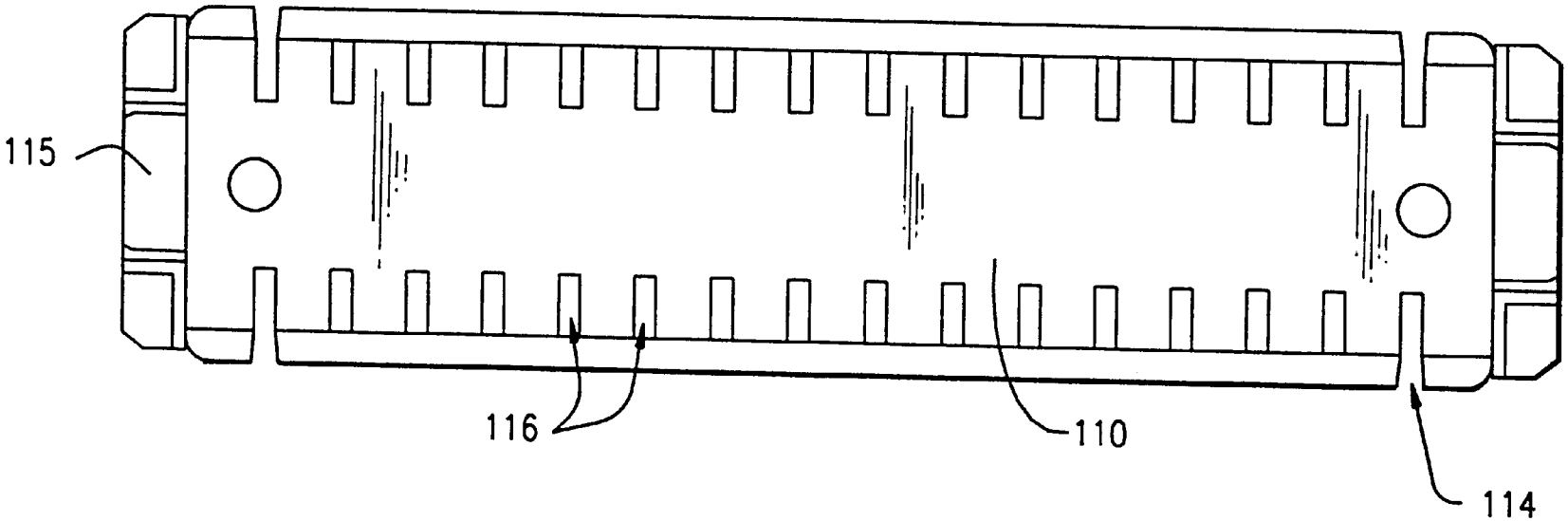
FIG. 12 shows a plan view of a retainer plate in the embodiment of FIG. 11.
Figure 13:
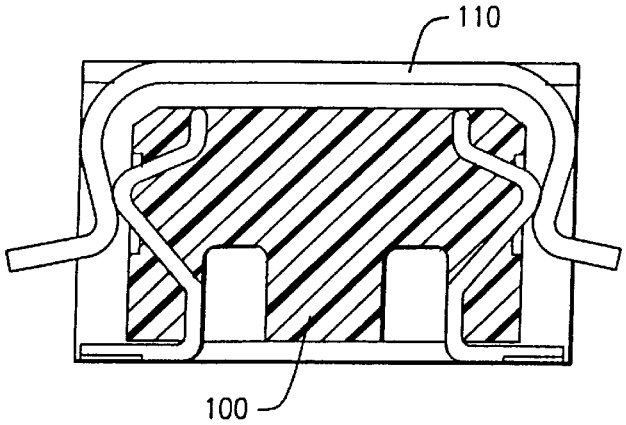
FIG. 13 shows a sectional view showing a connection status of a contact piece of the retainer plate and a contact in the embodiment of FIG. 11.

FIGS. 11–13 show other embodiment of the present invention.

In the present embodiment, contact pieces 113 provided at the opposite ends (four corners) of the retainer plate directly press and contact grounding/fixing contact (two contacts for each of the four corners of the connector body or total of eight in the illustrated embodiment) mounted at the both ends of the connector body without intervening the flexible flat cable (see FIG. 13). As a result, the grounding of the retainer plate is secured through the grounding/fixing contact. Further, when the connector body is mounted on the printed circuit board, the contact piece of the retainer plate directly presses the contact so that the connector body is fixed without floating from the printed circuit board. (Namely, the soldering of the contact to the printed circuit board is secured.)

In the illustrated embodiment, the contact piece is formed separately from the retainer plate body by a split groove 114 formed along the minor direction of the retainer plate. As a result, the grounding/fixing contact may be pressed by a portion of the retainer plate without providing a fixing pad separately from the retainer plate.

In the present embodiment, the retainer plate is provided with window holes 116 at an appropriate interval along the longitudinal direction as shown in FIG. 12. In respective embodiments of the present invention including the present embodiment, the numbers of electrodes (leads and contacts) of the cable and the connector are appropriately shown and the numbers may not necessarily match.

The retainer plate of the present embodiment is provided with engagement pieces 115 extending longitudinally at both ends thereof. On the other hand, the connector body is provided with recesses 102 for engaging with the engagement pieces of the retainer plate.

Figure 14:
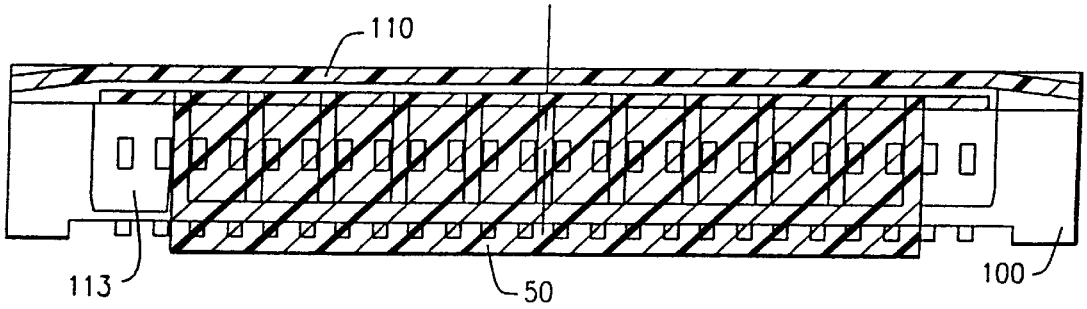
FIG. 14 shows a sectional view showing a status in which a retainer plate still another embodiment of the present invention is mounted to a connector body.
Figure 15:
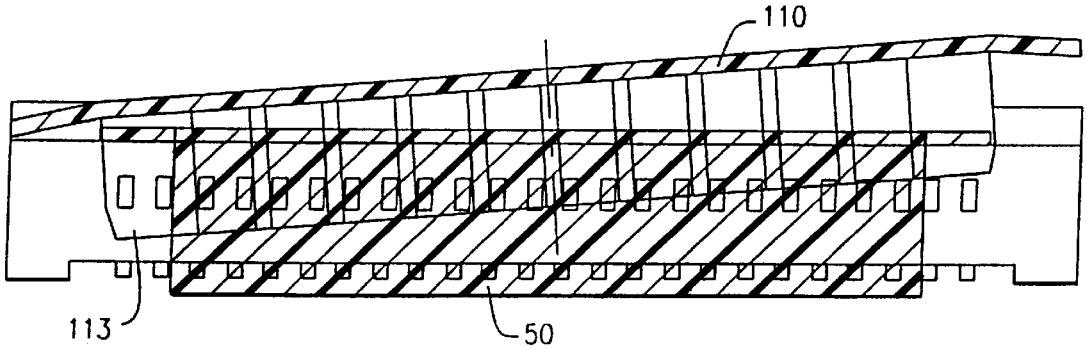
FIG. 15 shows a sectional view showing a status of detaching the retainer plate in the embodiment of FIG. 14.

FIGS. 14 and 15 shows another embodiment of the contact pieces and engagement pieces of the retainer plate. The engagement piece of the retainer plate is shaped such that it extends with downward inclination and has a side of the contact piece cut away so that the outer area of the split groove is wider than the inner area (which is closer to the center axis of the retainer plate).

By extending the engagement piece of the retainer plate with the downward inclination, a support point when the retainer plate is to be removed from the connector body is farther than that when the plane of the engagement piece of the retainer plate is planar as shown in FIG. 15. Accordingly, an open angle of the retainer plate to the connector body is small and the removal of the retainer plate from the connector body is eased accordingly.

By making the split groove of the contact piece wider in the outer area than in the inner area, even if the retainer plate is inclined with respect to the connector body as shown in FIG. 15 when the retainer plate is removed from the connector body, the retainer plate may escape the cable because the contact piece of the retainer plate is cut so that the damage of the cable by the contact piece is prevented.

The flexible flat cable of the present invention is provided with the two sets of conductor groups on one or both surfaces of the base film to improve the integrity of the conductors. Further, since the partially exposed areas of the conductors (which serve as the leads or electrodes) are aligned for each conductor group, the access to the respective conductor groups is facilitated.

In the embodiment having the shield area integrally extended along the width of the cable, the cable may be shielded by connecting the conductor plane of the shield area to the grounding conductor of the cable.

The connector of the present invention is provided with a plurality of contacts on each of the opposite sides along the longitudinal side of the connector body and pinches the flexible flat cable by the connector body and the retainer plate to electrically connect the contacts of the connector and the exposed areas of the conductors. Accordingly, even if the number of leads (electrodes) of the cable increases, the arrangement pitch of the contacts of the corresponding connector need not be unduly reduced and sufficient mechanical strength is maintained. Further, sufficient contact area of the leads of the cable and contacts is secured and the cable and the contacts can be connected without failure of contact.

What is claimed is:

1. An electrical cable assembly comprising:

a flat flexible cable including;

an insulating base film (10);

at least two sets of conductor groups (20, 30) each having a plurality of parallel arranged conductors provided in one or both surfaces of said base film; and an insulating cover layer (40, or 40 and 50) for covering said conductor groups;

wherein a location adjacent an end (60 or 60') of said cable has on one surface thereof spaced apart conductor contact areas (21, 31) formed by directly exposing the conductors of said conductor groups or partially exposing conductor areas electrically connected to said conductors, and the conductor contact areas are aligned along the width of the cable for each conductor group;

an elongate cable connector body; and a retainer plate for supporting said cable and providing insertable positioning of said cable over said connector body;

wherein said cable connector body is provided with a plurality of contacts (130, 140) on opposite longitudinal sides of said connector body, said flexible flat cable being pinched between each of said longitudinal sides of said cable connector body and said retainer plate by a spring force applied by said retainer plate and, contacting said spaced apart conductor contact areas (21,31) of said cable to the corresponding contacts on said opposite longitudinal sides of said connector body to make electrical connection therebetween.

2. A cable assembly according to claim 1 wherein each of said plurality of contacts has a contact area (131, 141) extending from the cable connector body at a position corresponding to said conductor contact area.

3. A cable assembly according to claim 2 wherein said cable connector body and said retainer plate have engagement means (150) for engaging with each other with said flexible flat cable being pinched therebetween.

4. A connect according to claim 3 wherein said engagement means comprises a projection (151) provided at each of the opposite side along a minor direction of said connector body and an engagement hole (152) of the retainer plate for engaging with said projection.

* * * * *